US008833816B2

(12) United States Patent
Hoffman

(10) Patent No.: US 8,833,816 B2
(45) **Date of Patent: *Sep. 16, 2014**

(54) COLLECTION DEVICE FOR PET WASTE MATERIAL

(71) Applicant: Craig A. Hoffman, Austin, TX (US)

(72) Inventor: Craig A. Hoffman, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/850,880

(22) Filed: Mar. 26, 2013

(65) Prior Publication Data

US 2013/0221693 A1 Aug. 29, 2013

Related U.S. Application Data

(63) Continuation-in-part of application No. 13/090,465, filed on Apr. 20, 2011, now Pat. No. 8,403,386.

(60) Provisional application No. 61/325,997, filed on Apr. 20, 2010.

(51) Int. Cl.

| | |
|---|---|
| ***A01K 29/00*** | (2006.01) |
| ***E01H 1/00*** | (2006.01) |
| ***E01H 1/12*** | (2006.01) |

(52) U.S. Cl.

CPC ..... *E01H 1/006* (2013.01); *E01H 1/1206* (2013.01); *E01H 2001/126* (2013.01)

USPC ..... 294/1.3

(58) Field of Classification Search

USPC ..... 294/1.3, 1.4, 1.5

See application file for complete search history.

(56) References Cited

U.S. PATENT DOCUMENTS

| | | | | |
|---|---|---|---|---|
| 3,767,247 | A | 10/1973 | Wetzler | |
| 4,188,055 | A | 2/1980 | Green | |
| 4,194,777 | A | 3/1980 | Carns | |
| 4,273,370 | A * | 6/1981 | Kjaer | 294/1.3 |
| 4,323,272 | A | 4/1982 | Fortier | |
| 4,747,633 | A | 5/1988 | Stacy | |
| 5,344,200 | A | 9/1994 | Yoshioka | |
| 5,476,296 | A | 12/1995 | Gross | |
| 5,620,220 | A | 4/1997 | Khoshnood | |
| 5,669,645 | A * | 9/1997 | Chuang | 294/1.3 |
| 5,725,268 | A | 3/1998 | Besasie et al. | |
| 6,059,332 | A * | 5/2000 | Beascoechea Inchaurraga | 294/1.3 |
| 7,063,365 | B1 | 6/2006 | Chase | |
| 7,523,972 | B1 * | 4/2009 | Wawrzynowski | 294/1.3 |
| D604,914 | S * | 11/2009 | Boghozian | D30/162 |
| 7,862,094 | B1 | 1/2011 | Lamont et al. | |
| 7,976,083 | B2 | 7/2011 | Black et al. | |
| 8,292,338 | B1 * | 10/2012 | Baghdasaryan | 294/1.3 |

(Continued)

*Primary Examiner* — Saul Rodriguez
*Assistant Examiner* — Gabriela Puig
(74) *Attorney, Agent, or Firm* — Scott T. Griggs; Griggs Bergen LLP

(57) ABSTRACT

A collection device for pet waste material and method for use of the same are disclosed. In one embodiment, a pair of opposing shells extends from a base at which there is pivotally attachment of the opposing shells. The pair of opposing shells are pivotally movable between a closed shell state with the respective shell ends proximate each other and an open shell state wherein the shell ends are spaced from each other. A bag when folded upon itself may have its pouch inserted into the collection device and held therein between the pair of opposing shells. A pair of pockets are respectively coupled to each of the outer surfaces of the shells and configured to accept fingers for grasping and manipulating the collection device between the closed shell state and the open shell state.

14 Claims, 5 Drawing Sheets

(56) References Cited

U.S. PATENT DOCUMENTS

| | | | | |
|---|---|---|---|---|
| 2003/0131393 | A1 | 7/2003 | Votolato | |
| 2004/0222650 | A1 | 11/2004 | Colesanti et al. | |
| 2007/0228749 | A1 | 10/2007 | Vollmer | |
| 2009/0261603 | A1 * | 10/2009 | Boghozian | 294/1.3 |
| 2009/0315349 | A1 | 12/2009 | Black et al. | |
| 2011/0193359 | A1 * | 8/2011 | Howard | 294/1.3 |
| 2012/0098281 | A1 * | 4/2012 | Sigmund | 294/1.3 |

* cited by examiner

COLLECTION DEVICE FOR PET WASTE MATERIAL

PRIORITY STATEMENT & CROSS-REFERENCE TO RELATED APPLICATIONS

This application claims priority from, and is a continuation-in-part of, U.S. patent application Ser. No. 13/090,465, entitled "Collection Device for Pet Waste Material" and filed on Apr. 20, 2011 in the name of Craig A. Hoffman, which issued on Mar. 26, 2013 as U.S. Pat. No. 8,403,386; which claims priority from U.S. Patent Application No. 61/325,997, entitled "Collection Device for Pet Waste Material" and filed on Apr. 20, 2010, in the name of Craig A. Hoffman; both of which are hereby incorporated by reference for all purposes.

TECHNICAL FIELD OF THE INVENTION

This invention relates, in general, to devices and methods for collecting solid pet waste and, in particular, to devices which may be manually manipulated to pick up and dispose of animal waste in a container and to a method of utilizing such devices with no or minimal manual contact with the waste-holding container.

BACKGROUND OF THE INVENTION

Even though the collection of animal and pet waste material, including excrement and vomit, is mandatory and required by municipal ordinance in many cities and towns, the vast majority of pet owners collect pet waste as a matter of general courtesy and environmental respect. This is true despite the fact that the collection of pet waste is an undesirable practice due, in part, to the warm pliable nature of pet waste. Currently, the most common method for collecting pet waste material is placing a plastic bag over the hand to fashion a free-form glove. The pet waste material is then scooped up in the hand and, once collected, the bag is removed from the hand in an inside-out fashion to capture the pet waste in the plastic bag for proper disposal. Despite existing techniques for the disposal of pet waste, a need exists for improved pet waste collection devices that address the warm pliable nature of pet waste.

SUMMARY OF THE INVENTION

It would be advantageous to achieve a pet waste collection device that address the warm pliable nature of pet waste. It would also be desirable to enable a mechanical solution that would mitigate the negative factor's associated with pet waste collection. To better address one or more of these concerns, a collection device for pet waste material and method for use of the same are disclosed. In one embodiment, a pair of opposing shells extends from a base at which there is pivotal attachment of the opposing shells. The pair of opposing shells are pivotally movable between a closed shell state with the respective shell ends proximate each other and an open shell state wherein the shell ends are spaced from each other. A bag when folded upon itself may have its pouch removably inserted into the collection device and held therein between the pair of opposing shells. A pair of pockets, which may be foldable or collapsible, are respectively coupled to each of the outer surfaces of the shells and configured to accept fingers for grasping and manipulating the collection device between the closed shell state and the open shell state. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1A:
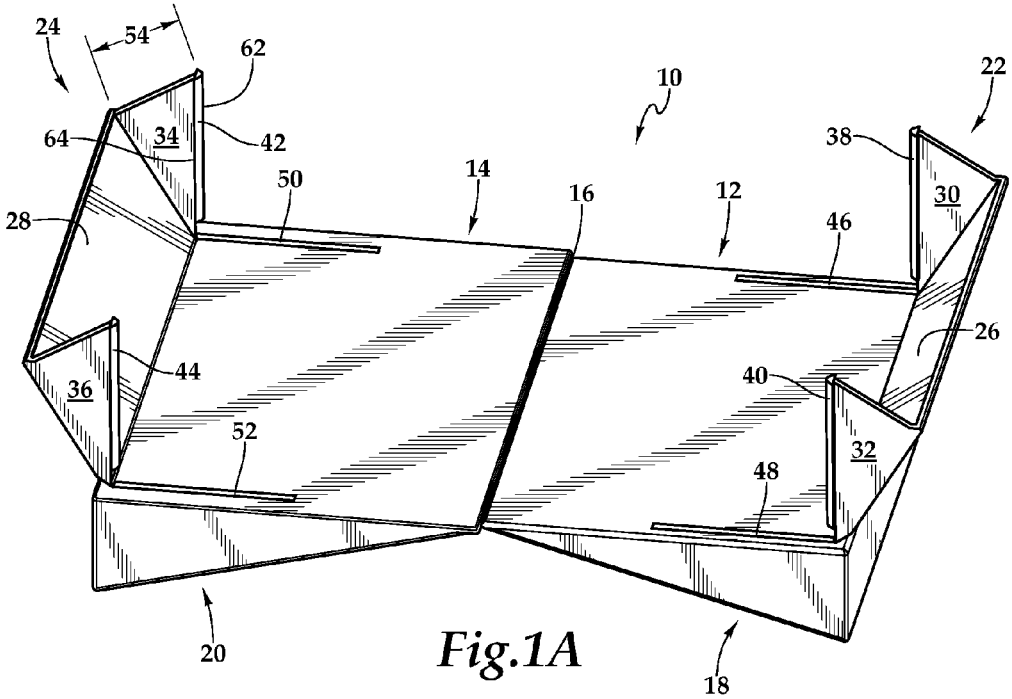
FIG. 1A is a side perspective of one embodiment of the collection device for pet waste material.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Referring to FIGS. 1A through 2B, therein is depicted a collection device that is schematically illustrated and generally designated 10. A pair of opposing shells 12, 14 having respective shell ends extend from a base 16. Each of the pair of opposing shells 12, 14 includes an inner surface and an outer surface. The opposing shells 12, 14 are positioned such that the inner surfaces face each other. A lip 18 forming three fixed sides extends from an edge of the opposing shell 12 and similarly a lip 20 extends from an edge of the opposing shell 14. In one implementation, the pair of opposing shells 12, 14 include a thermoplastic material. Moreover, the collection device 10 may be of a rectangular shape.

The pair of opposing shells 12, 14 are pivotally affixed at the base 16, which may include a living hinge which permits the opposing shells 12, 14 to flex preferentially at the living hinge in response to a bending force or urging from a human hand. In particular, in one embodiment, the opposing shells are pivotally affixed at the base 16 in a non-biasing relationship by the living hinge. A pair of pockets 22, 24 are respectively coupled to each of the outer surfaces. Each of the pair of pockets 22, 24 is configured to accept fingers or a thumb, depending on how the collection device 10 is held in the hand.

The pair of opposing shells 12, 14 are pivotally movable between a closed shell state with the respective shell ends proximate each other and an open shell state wherein the jaw ends are spaced from each other. In the open shell state, the opposing shells 12, 14 are adapted to accept a pouch of a bag liner. As will be discussed in further detail below, by way of manipulation of the fingers and thumb, the opposing shells 12, 14 may transition between the open shell state and the closed shell state, which may be an overlapping relationship or overbite relationship in the closed shell state.

Figure 1B:
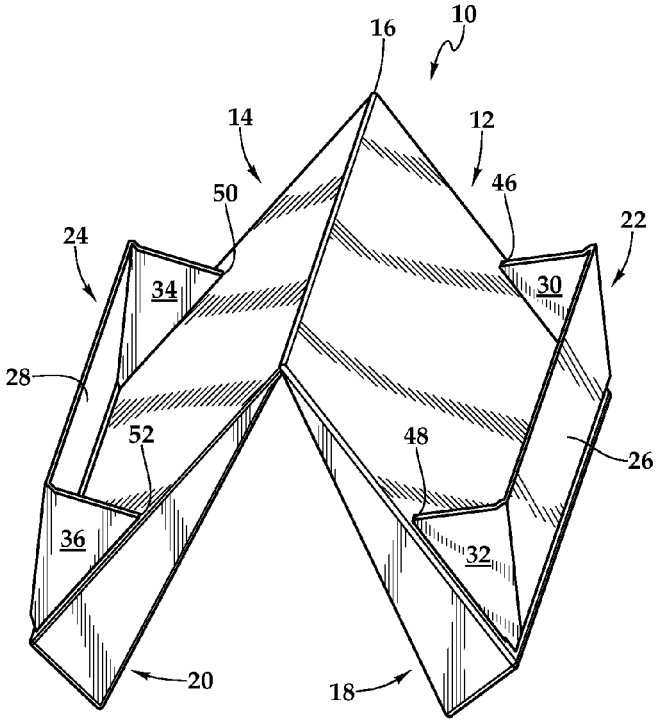
FIG. 1B is another side perspective of one embodiment of the collection device for pet waste material.

Referring to FIGS. 1A and 1B, the pockets 22 and 24 of the collection device 10 are comprised by foldable flaps 26 and 28 and by support members 30, 32, 34, and 36. Foldable flaps 26 and 28 can fold substantially flat against the outer surface of respective shells 12 and 14 to a first position (not shown) that is convenient for compact storage of the collection device 10. The foldable flaps 26 and 28 can fold to a second position (see FIG. 1B) to accept one or more fingers for when the collection device 10 is in use. A distal end of each of the foldable flaps 26 and 28 are attached to a distal end of respective shells 12 and 14 with the living hinge 16 at proximal ends of the shells 12 and 14.

Support members 30, 32, 34, and 36 support respective foldable flaps 26 and 28 in the first and second positions. Support members 30, 32, 34, and 36 also limit a distance 54 that proximal ends of the foldable flaps can travel away from the outer surfaces of respective shells 12 and 14. Support members 30, 32, 34, and 36 are affixed to an edge of respective foldable flaps 26 and 28 and to its respective shells 12 and 14. Alternative embodiments may have a support member affixed to one of an edge of a foldable flap and its respective shell.

Additionally, support members 30, 32, 34, and 36 may be affixed to respective shells 12 and 14 via a tabs 38, 40, 42, and 44 at one end of each of support members 30, 32, 34, and 36. Tabs 38, 40, 42, and 44 fit into respective slots 46, 48, 50, and 52 of shells 12 and 14. After tabs 38, 40, 42, and 44 are passed through slots 46, 48, 50, and 52, support members 30, 32, 34, and 36 may slide freely through slots 46, 48, 50, and 52.

The tabs 38, 40, 42, 44 may be sized and designed to facilitate passing the tabs through the slots 46, 48, 50, and 52 easily in one direction but not on the other. In doing so, the distance 54 that the proximal ends of the foldable flaps 26 and can travel is limited. As illustrated, tab 42 comprises a leading edge with rounded portion 62 and a trailing edge with flat portion 64. Rounded portion 62 allows the support member 34 to pass through the outer surface of shell 14 via slot 50 so that foldable flap 28 may be closed into the first position. When foldable flap 28 is subsequently opened, the flat portion contacts the inner surface of shell 14 and prevents the foldable flap 28 from opening past the distance 54, thereby supporting the second position. Additionally, embodiments of the collection device 10 may be formed via a single mold as a single piece of thermoplastic material. In doing so, the molding and assembly costs of the collection device 10 are reduced.

Figure 2A:
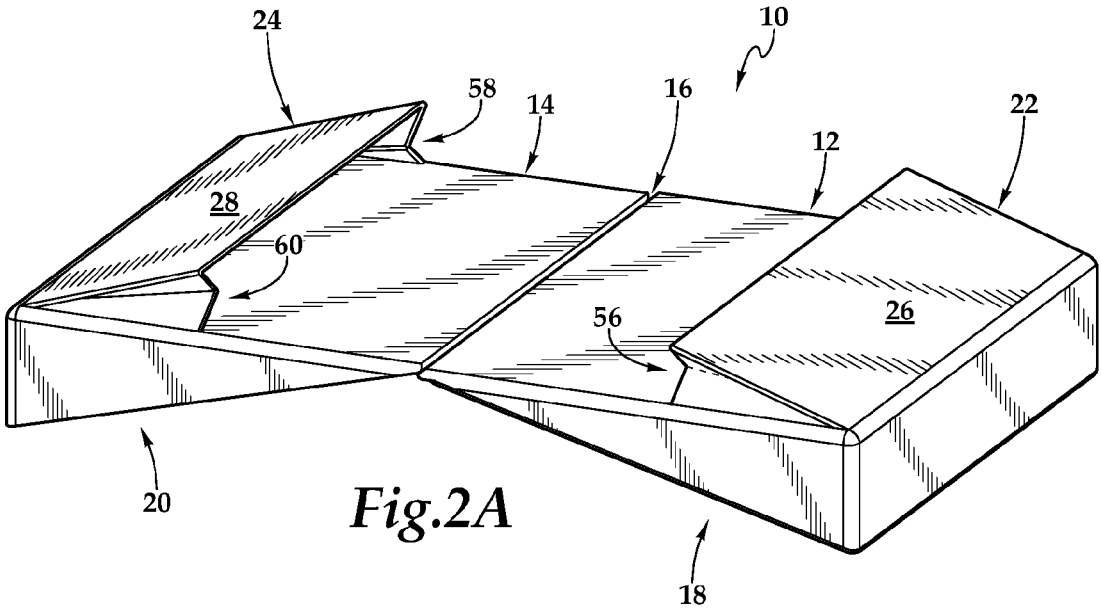
FIG. 2A is a side perspective of one embodiment of the collection device for pet waste material.
Figure 2B:
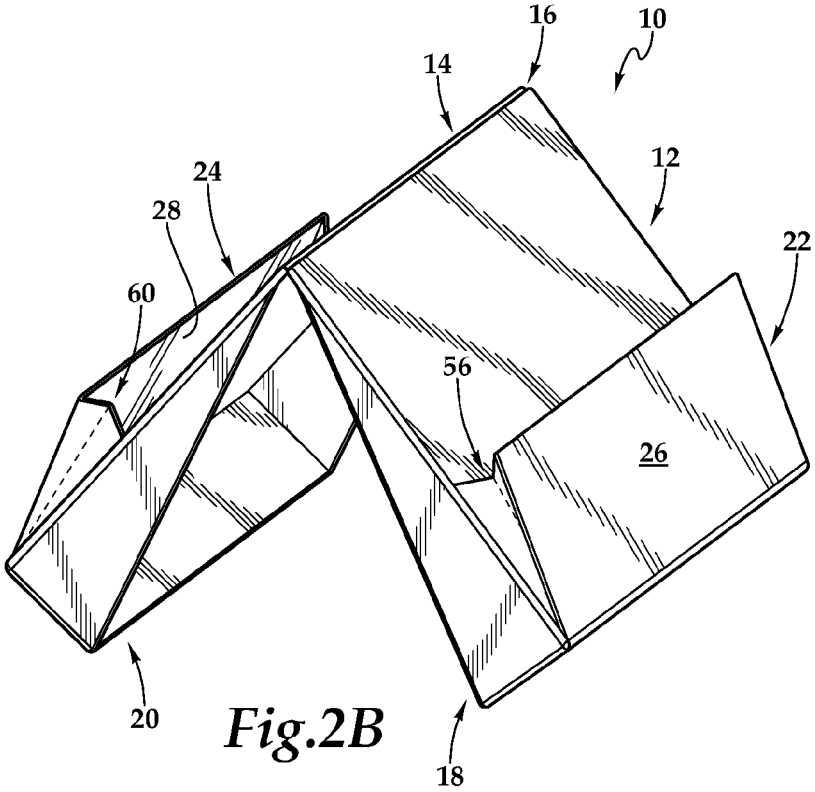
FIG. 2B is another side perspective of one embodiment of the collection device for pet waste material.

Referring to FIGS. 2A and 2B, the pockets 22 and 24 of the collection device 10 are comprised of support members 56, 58, and 60 that are each foldable to support foldable flaps 26 and 28 in the first position (not shown) for storage and the second position for use. Alternative embodiments may have a single support member for each flap and the flaps and pockets may be asymmetrically proportioned with respect to each other. As an example, one shell may comprise a pocket suitable for accepting four fingers with the other shell comprising a pocket suitable for accepting a thumb.

In one embodiment generally illustrating liner bag installation, the pouch of a liner bag is inserted into the collection device 10 which is positioned in the open state. A bag mouth of the liner bag is thereby formed at the intersection of the liner bag and the respective lips of the pair of opposing shells 12, 14. The liner bag may then be folded upon itself and the collection device 10 such that the bag mouth is removably inserted into the collection device and held therein between the pair of opposing shells 12, 14. The respective opposing lips extend from an edge of each of the opposing shells and in a tapered form. The opposing lips move in a mandibular motion toward and away from each other to releasably grip the liner bag and its contents.

Figure 3A:
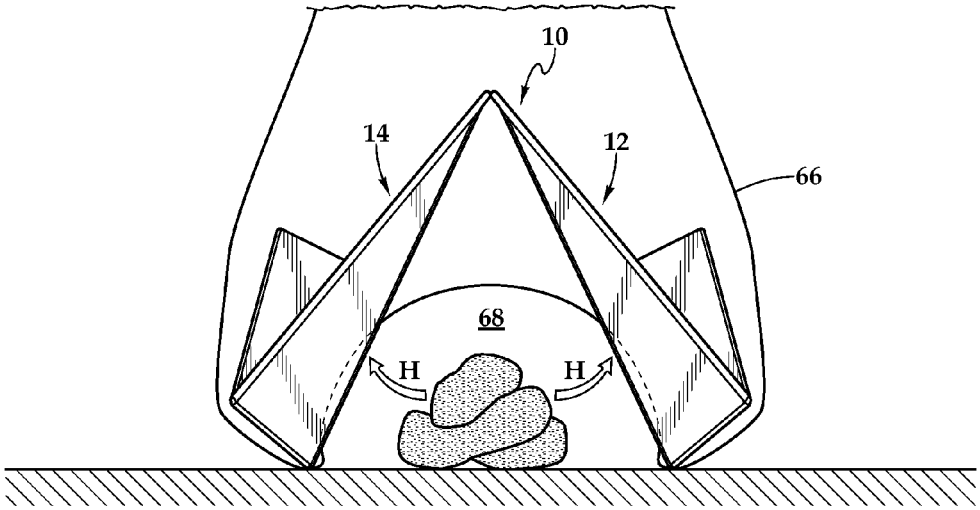
FIGS. 3A-3B are side perspectives of one embodiment of the collection device illustrating general operation of the collection device.
Figure 3B:
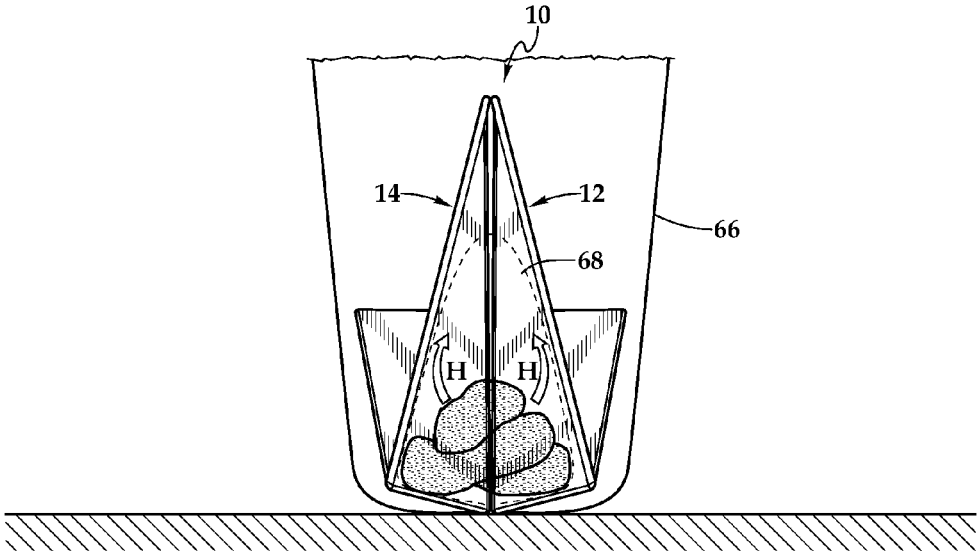
Figure 4:
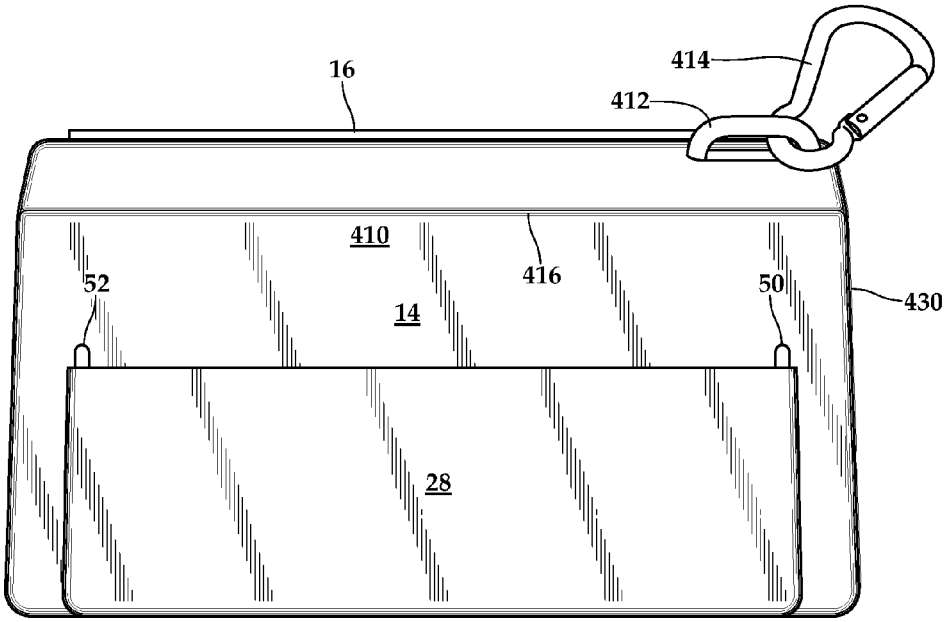
FIG. 4 is a front perspective view of another embodiment of the collection device.
Figure 5:
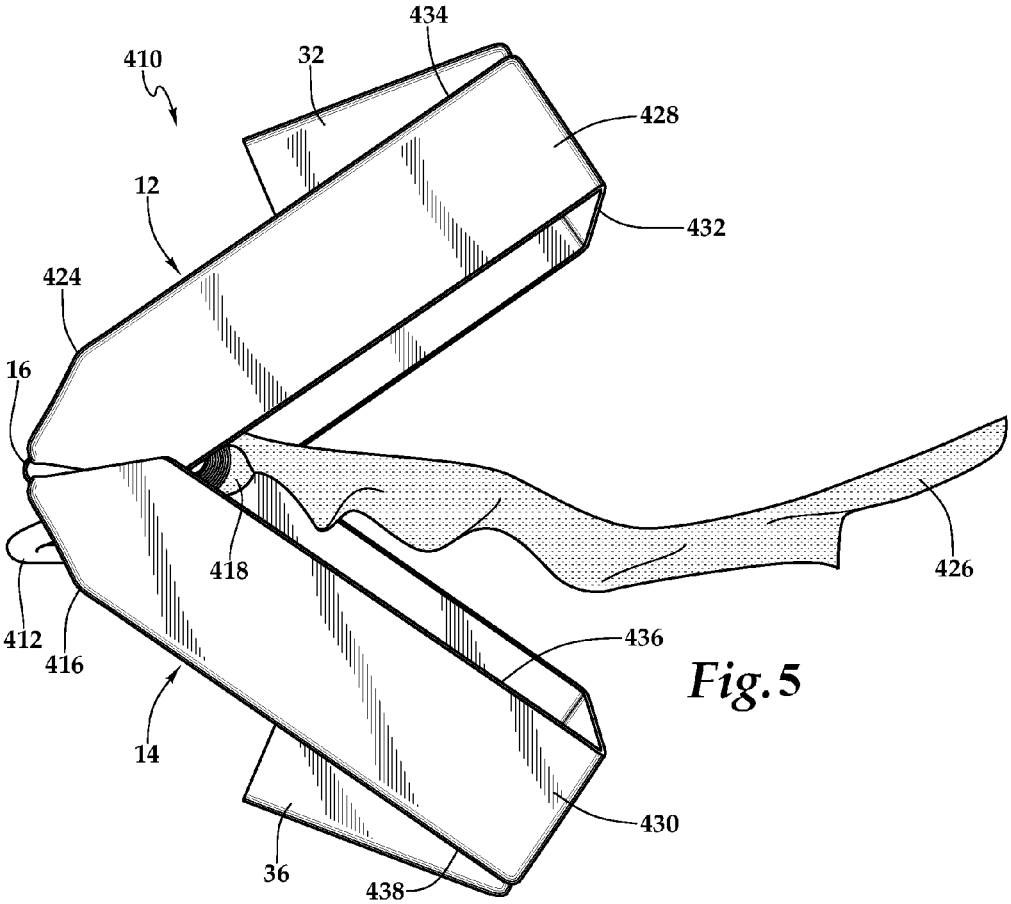
FIG. 5 is a side perspective view of the embodiment of the collection device shown in FIG. 4, wherein general operation of the collection device is illustrated.
Figure 7:
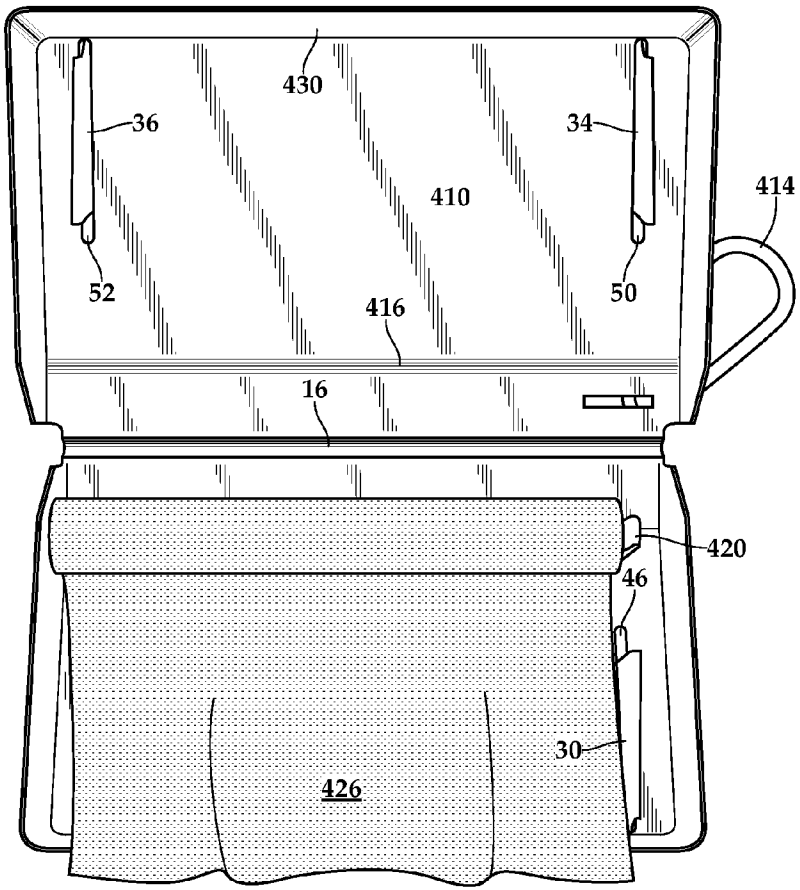
FIG. 7 is a front elevation view of the collection device shown in FIG. 5, wherein a roll of bags is installed.
Figure 6:
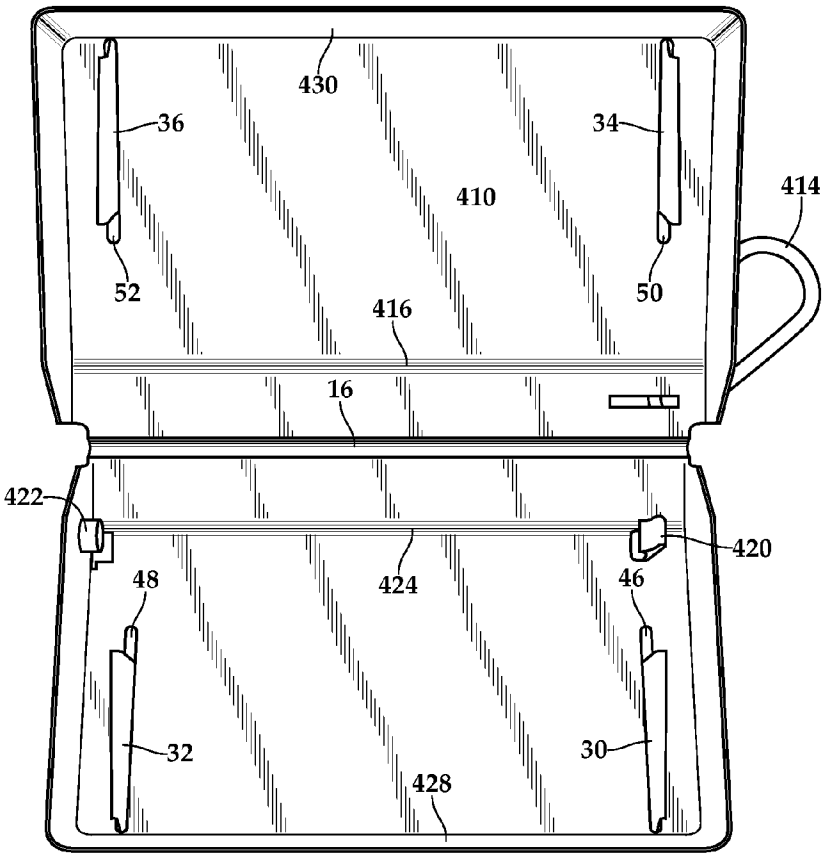
FIG. 6 is a front elevation view of the collection device shown in FIG. 4, prior to the installation of a roll of bags.

Referring to FIGS. 3A and 3B, one embodiment of general operation and waste collection is shown. The collection device 10 is first placed directly over the pet waste material. The collection device 10 is then lowered over the pet waste material, preferably until the opposing shells 12, 14 at edges contact the ground. The user, fingers inserted into one pocket and thumb into the other pocket (not shown), then begins to urge the collection device 10 from the open shell state of FIG. 3A to the closed shell state of FIG. 3B. In doing so, the lips 18, 20 slide underneath the pet waste material until they arrive in proximate contact in the closed shell state. As shown in FIG. 8B, the pet waste material is captured inside the liner bag 66 and the liner bag is held closed between the opposing shells 12, 14. The excess liner is folded back around the collection device 10 and hand (not shown) of the user.

The user may then unfold the portion of the liner bag that was previously folded upon itself and over the collection device 10. A twist or knot created with the liner bag or other fastener may then be used to seal liner bag and close the pet waste material into the pouch 68 of the liner bag 66. The collection device 10 may then be returned to the open shell state through manipulation by the hand (not shown). With the liner bag 66 released and waster material securely captured, disposal may then be made.

As previously mentioned, the collection of pet waste material is an undesirable practice due, in part, to the warm pliable nature of pet waste, as shown in part by the heat H emanating from the pet waste illustrated in FIG. 3A. The collection device 10 presented herein provides an insulation barrier between the pet waste material and the surface of the hand, as shown in FIG. 3B by the heat H remaining within the collection device 10. The collection device 10 thereby mitigates the offensiveness of pet waste collection.

Referring now to FIGS. 4-7, an alternative collection device embodiment 410 is constructed substantially the same as the embodiment shown in FIGS. 1A through 3B. Collection device 410 comprises a loop 412; a ring 414; ridges 416 and 424; a roll 418 of unused plastic bags secured thereon; one or more holding members (e.g., ends 420 and 422); a bag 426 attached to the roll 418; and edges 432-438 of lips 428 and 430.

The loop 412 is shown as being formed as a part of opposing shell 14 and assures convenient attachment to other objects, or for other objects to be attached to the collection device 410. The ring 414, depicted as a carabiner, allows attachment of the collection device 410 to various objects. Alternatively, the ring 414 could be used to attach the device 410 to a belt loop of a pair of pants.

The ridges 416 and 424 allow for the sides of opposing lips 428 and 430 to be more rectangular. As shown, in one embodiment, the lateral sides of the lips 428 and 430 are pentagonal so that the leading edges 432 and 436 of the opposing lips 428 and 430 are the substantially parallel to the trailing edges 434 and 438 of the opposing lips 428 and 430. Shaping the sides to be substantially parallel and the combination of the ridges 416 and 424 provide enough room to enclose the roll 418 within the device 410 and provides increased capacity for enclosing pet waste within the collection device 410 until it is disposed. As shown with reference to FIGS. 4 and 5, a lip 430 of the shell 14 fits within the lip 428 of the shell 12 in an overlapping or overbite relationship when the opposing shells 14 and 12 are in the closed shell state. Additionally, a friction fit between the lip 428, 430 may maintain the pet collection device 410 in the closed shell state.

The holding members hold a roll 418 of unused plastic bags for use with the collection device 410. The holding members comprise ends 420 and 422 that are shown as being formed as a part of opposing shell 12. The ends 420 and 422 securely store the roll 418 within the collection device 410. The ends 420 and 422 are shaped to accept the roll 418 and are spaced so that tension provided by the roll 418, when inserted into the ends 420 and 422, keeps the roll 418 held in place within device 410. The ends 420 and 422 are proximate to the hinge 16 to allow for the lips 430 and 428 to be able to scoop up pet waste and to allow for the storage of the pet waste within the device 410 until the pet waste can be properly disposed. The ends 420 and 422 are spaced so that roll 418 is held tight enough so that the roll 418 does not freely rotate within the device 410.

Alternative embodiments may have the ends 420 and 422 spaced so that the roll 418 can freely rotate to increase the ease at which a bag can be removed from the roll 418. Additionally, a bag can be removed from the roll by unrolling the bag enough so that a perforation separating one bag from the next is outside of the collection device, the collection device can then be closed so that the lips 428 and 430 act to hold the interconnected bags of the roll in place and the perforations can be forcefully torn so as to separate and disconnect the bag from the roll.

The roll 418 of unused plastic bags may include 10 to 15 individual bags on a perforated role. Holding the bags within the collection device 410 provides a place to conveniently store and carry the bags that will be used with the collection device 410. Additionally, holding the bags within the collection device 410 eliminates to need to carry extra bags outside of the collection device 410, such as in a pocket of a pair of pants.

As shown, in one embodiment each of the pair of the pockets 32, 36 includes a collapsible flap that can collapse substantially flat against the outer surface of its respective shell 12, 14 to a first position for compact storage. Additionally, the collapsible flaps can open to a second position to accept the one or more fingers, and a distal end of the collapsible flap is attached to a distal end of the shell with the living hinge 16, which may be a hinge, at a proximal end of the shell. Each of the pair of the pockets 32, 36 includes a support member to support the collapsible flap in the first and second positions and limit a distance that a proximal end of the collapsible flap can travel away from the outer surface of the shell. As shown, the support member is affixed to at least one of an edge of the collapsible flap and its respective shell, such that the support member is selectively and adjustably affixed to the shell at one end of the support member that fits into a slot on the shell and the support member moves so that the collapsible flap may move between the first and second positions.

It should be appreciated that variations on the general operation are within the teachings presented herein. For example, the collection device 10 may be operated in a scoop-like manner in the event that waste material is not deposited in a single location. In this case, the collection device 10 may be used in a scoop-like manner to gather all waste in a single location before the collection device 10 is used in a manner to that previously described.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A collection device for pet waste comprising:

a pair of opposing shells extending from a base and having respective shell ends, the pair of opposing shells being pivotally affixed at the base in a non-biasing relationship by a living hinge, the pair of opposing shells are pivotally movable between a closed shell state with the respective shell ends proximate each other and an open shell state wherein the shell ends are spaced from each other;

each of the pair of opposing shells including an inner surface and an outer surface;

respective opposing lips extending from an edge of each of the opposing shells, the opposing lips moving in a mandibular motion toward and away from each other to releasably grip a bag and contents thereof therebetween;

a pair of pockets respectively coupled to each of the outer surfaces, each of the pair of pockets configured to accept a plurality of one or more fingers; and one or more holding members holding a roll of unused plastic bags within the collection device;

the pockets each comprise a foldable flap that collapses substantially flat against the outer surface of its respective shell to a first position for compact storage, the foldable flap opening to a second position to accept the one or more fingers, and a distal end of the foldable flap is attached to a distal end of the shell with the living hinge at a proximal end of the shell;

the pockets each comprise a support member to support the foldable flap in the first and second positions and limit a distance that a proximal end of the foldable flap can travel away from the outer surface of the shell, and the support member is affixed to at least one of an edge of the foldable flap and its respective shell; and the support member is affixed to the shell via a tab at one end of the support member that fits into a slot on the shell and the support member folds so that the foldable flap may move between the first and second positions.

2. The collection device as recited in claim 1 comprising the respective opposing lips each comprising a leading edge and a trailing edge that are substantially parallel to each other.

3. The collection device as recited in claim 1, wherein a first lip of the opposing lips associated with a first shell of the opposing shells fits within a second lip of the opposing lips associated with a second shell of the opposing shells in an over-bite relationship when the opposing shells are in the closed shell state.

4. The collection device as recited in claim 1, wherein the pair of opposing shells further comprise a thermoplastic material.

5. The collection device as recited in claim 1, wherein the pair of opposing shells further comprise a rectangular shape.

6. The collection device as recited in claim 1, wherein the living hinge moves in response to urging from a human hand.

7. The collection device as recited in claim 1, wherein the shells, foldable flap, and support member are formed as a single piece of thermoplastic material.

8. A method for a pet waste collection device comprising:

extending a pair of opposing shells from a base, the pair of opposing shells having respective shell ends;

pivotally affixing the pair of opposing shells at the base in a non-biasing relationship by a living hinge, the pair of opposing shells being pivotally movable between a closed shell state with the respective shell ends proximate each other and an open shell state;

spacing the shell ends from each other;

including an inner surface and an outer surface in each of the pair of opposing shells;

extending respective opposing lips from an edge of each of the opposing shells;

moving the opposing lips in a mandibular motion toward and away from each other to releasably grip a bag and contents thereof therebetween;

receiving one or more fingers with a pair of pockets respectively coupled to each of the outer surfaces, each of the pair of pockets configured to accept one or more fingers; and holding a roll of unused plastic bags within the collection device via one or more holding members;

folding substantially flat a foldable flap of each of the pockets against the outer surface of its respective shell to a first position for compact storage;

opening the foldable flap to a second position to accept the one or more fingers;

affixing a distal end of the foldable flap to a distal end of the shell with the living hinge at a proximal end of the shell supporting the foldable flap with a support member for each of the pockets;

limiting a distance that a proximal end of the foldable flap can travel away from the outer surface of the shell; and affixing the support member to at least one of an edge of the foldable flap and its respective shell;

affixing the support member to the shell via a tab at one end of the support member that fits into a slot on the shell; and folding the support member so that the foldable flap may move between the first and second positions.

9. The method of claim 8 further comprising including a leading edge and a trailing edge that are substantially parallel to each other for the respective opposing lips.

10. The method of claim 8 further comprising fitting a first lip of the opposing lips associated with a first shell of the opposing shells within a second lip of the opposing lips associated with a second shell of the opposing shells when the opposing shells are in the closed shell state.

11. The method of claim 8, further comprising including thermoplastic material in the pair of opposing shells.

12. The method of claim 8, further comprising forming the pair of opposing shells as a rectangular shape.

13. The method of claim 8 further comprising moving the living hinge in response to urging from a human hand.

14. A collection device for pet waste comprising:

a pair of opposing shells extending from a base and having respective shell ends, the pair of opposing shells being pivotally affixed at the base in a non-biasing relationship by a hinge, the pair of opposing shells are pivotally movable between a closed overlapping shell state with the respective shell ends proximate each other and an open shell state wherein the shell ends are spaced from each other;

each of the pair of opposing shells including an inner surface and an outer surface;

respective opposing lips extending from an edge of each of the opposing shells, the opposing lips moving in a mandibular motion toward and away from each other to releasably grip a bag and contents thereof therebetween;

a pair of pockets respectively coupled to each of the outer surfaces, each of the pair of pockets configured to accept a plurality of one or more fingers;

each of the pair of the pockets includes a collapsible flap that can collapse substantially flat against the outer surface of its respective shell to a first position for compact storage, the collapsible flap can open to a second position to accept the one or more fingers, and a distal end of the collapsible flap is attached to a distal end of the shell with the living hinge at a proximal end of the shell; and each of the pair of the pockets includes a support member to support the collapsible flap in the first and second positions and limit a distance that a proximal end of the collapsible flap can travel away from the outer surface of the shell, and the support member is affixed to at least one of an edge of the collapsible flap and its respective shell, the support member being selectively and adjustably affixed to the shell at one end of the support member that fits into a slot on the shell and the support member moves so that the collapsible flap may move between the first and second positions.

* * * * *